United States Patent [19]

Alblrecht et al.

[11] Patent Number: 5,005,504

[45] Date of Patent: Apr. 9, 1991

[54] THREAD CUTTING DEVICE HAVING A TRANSLATABLY SLIDABLE KNIFE AND CATCHER, BEING DRIVEN FOR FORMING UNIFORMLY SHORT STITCH THREAD ENDS IN A ZIG ZAG SEWING MACHINE

[75] Inventors: Ernst Alblrecht, Hochspeyer; Harald Dinges, Kaiserslautern, both of Fed. Rep. of Germany

[73] Assignee: G. M. Pfaff Aktiengesellschaft, Kaiserslautern, Fed. Rep. of Germany

[21] Appl. No.: 438,438

[22] PCT Filed: Apr. 19, 1988

[86] PCT No.: PCT/EP88/00329

§ 371 Date: Dec. 28, 1989

§ 102(e) Date: Dec. 28, 1989

[87] PCT Pub. No.: WO88/08894

PCT Pub. Date: Nov. 17, 1988

[30] Foreign Application Priority Data

May 9, 1987 [DE] Fed. Rep. of Germany ..... 3715603

[51] Int. Cl.[5] ..... D05B 65/00; D05B 65/02

[52] U.S. Cl. ..... 112/292; 112/291; 112/285; 112/293; 112/295; 112/296; 112/298; 112/157

[58] Field of Search ..... 112/122, 129, 130, 181, 112/187, 189, 228, 285, 286, 288, 291, 292, 293, 296, 297, 298, 300

[56] References Cited

U.S. PATENT DOCUMENTS

| | | | |
|---|---|---|---|
| 3,413,944 | 12/1968 | Spinard | 112/292 X |
| 3,701,329 | 10/1972 | Olney | 112/300 X |
| 4,455,957 | 6/1984 | Vollmar | 112/292 OR |
| 4,566,395 | 1/1986 | Tummino | 112/292 |
| 4,726,305 | 2/1988 | Seto | 112/292 X |

FOREIGN PATENT DOCUMENTS

| | | | |
|---|---|---|---|
| 1941794 | 3/1971 | Fed. Rep. of Germany | 112/292 |
| 0400639 | 5/1974 | U.S.S.R. | 112/296 |

*Primary Examiner*—Werner H. Schroeder
*Assistant Examiner*—Ismael Izaguirre
*Attorney, Agent, or Firm*—McGlew & Tuttle

[57] ABSTRACT

A thread-cutting device for zigzag sewing machines for forming uniformly short thread ends regardless of the top stitch position of the last stitch. The thread cutter 28 is movable in a plane that is parallel to the thread catcher 33 and is connected by a drive unit 45 through 58 having stop sections 54, 55 to the drive of the thread catcher 33 such that the thread catcher can be moved, together with the cutter, into the cutting position located below the center of the stitch hole. While the thread cutter 28 stops in the cutting position, the thread catcher completes the thread separation process. The thread cutter 28 is moved back during the return movement of the thread catcher 33 only after the threads have been cut. The drive unit 45 through 58 for the thread cutter 28 is of positive-locking design, as a result of which even thick threads are cut reliably. The thread cutting device is particularly suitabloe for installation (even subsequent installation) in stitch group zigzag sewing machines.

4 Claims, 3 Drawing Sheets

THREAD CUTTING DEVICE HAVING A TRANSLATABLY SLIDABLE KNIFE AND CATCHER, BEING DRIVEN FOR FORMING UNIFORMLY SHORT STITCH THREAD ENDS IN A ZIG ZAG SEWING MACHINE

FIELD AND BACKGROUND OF THE INVENTION

This invention relates in general to a thread cutting device and in particular to thread cutting devices leaving uniform length ends on zig zag sewing machines.

A similar thread cutting device is known from West German Utility Patent DE-GM No. 1,968,920. In this thread cutting device, the thread cutter, cooperating with the cutting edge of the thread take-up is attached to the lower side of the needle plate at a location spaced laterally from the stitch hole, of oblong shape.

Since the needle has a greater distance from the stationary thread cutter during zigzag sewing in overstitch position than in the other, there will be thread ends of different lengths on the fabric sewn after the thread is cut; the shortest thread ends will be formed in the overstitch position facing the thread cutter, and the longest thread ends will be in the overstitch position facing away from it.

West German Patent Specification DE-PS No. 31,24,795 discloses another thread cutting device for zigzag sewing machines, in which the thread take-up has, on its site opposite the barb, a second barb for the needle thread loop leg leading to the needle in order to make the length of the needle thread ends connected to the needle and the thread reservoir independent of the stitching position of the needle. However, the arrangement of the second barb does not affect the length of the thread ends on the fabric being sewn, i.e., their length depends on the last stitching position, just as in the first thread cutting device.

Finally, West German Patent Specification No. 17,60,703 discloses a thread cutting device for double chain stitch sewing machines, which has a thread take-up that can be moved in parallel to the plane of the needle plate and has a cutting edge, as well as a thread cutter that is arranged in parallel to this and can be moved in the same direction, and a thread clamp that can be moved together with the thread cutter. The thread take-up is provided with a lug that engages with one elongated slot of the thread cutter and one thread clamp each, such that the thread cutter and the thread clamp move together with the thread take-up from the resting position into the work position and vice versa whenever the pin has traveled over the entire length of the elongated slots. To prevent the thread cutter and the thread clamp from moving prematurely and in an uncontrolled fashion, they are held in their two end positions by a spring-loaded ratchet mechanism.

Aside from the fact that this thread cutting device was not designed for double lock stitch but for double chain stitch sewing machines, which are used for straight sewing rather than for zigzag sewing, it is also unsuitable for cutting through thicker threads of greater tear strength, which offer such a great resistance to cutting that the force to be applied for cutting is greater than the holding force of the spring-loaded ratchet mechanism, because in this case, the thread cutter would be forced out of the actually intended cutting position located in the immediate vicinity of the stitch hole before the threads are cut through completely, and the cutting process would be completed only in the starting position of the thread cutter located relatively far from the stitch hole. However, undesirably long thread ends would thus be obtained on the fabric sewn.

SUMMARY AND OBJECTS OF THE INVENTION

The basic task of the present invention is to design a thread cutting device for zigzag sewing machines such that uniformly short thread ends are obtained on the fabric sewn regardless of the top stitch position of the last stitch. This task is achieved by a cutting knife movable in a plane parallel to a thread catcher. The cutting knife is connected to the drive of the gear mechanism such that together with the thread catcher, the cutting knife can be moved from a resting position, located to the side of the stitchhole, into a cutting position located in an area under the middle of the overstitch width. The thread catcher then can be moved farther to engage the thread while the cutting knife is stationary. After engaging the threads, the thread catchers move back in the direction of the cutting knife in order to cut the threads.

By moving the thread cutter into a cutting position that is below the center of the top stitch width and consequently below the center of the longitudinal extension of the stitch hole, the leg of the needle thread loop on the side of the fabric and the shuttle thread are always cut off at a particularly short distance from the fabric. The top stitch position of the last stitch does not appreciably affect the result of cutting, so that equally short thread ends are essentially always obtained.

By connecting the thread cutter with the drive of the thread take-up via a positive-locking drive mechanism, positive coupling of the movement of the thread catcher with that of the thread cutter is achieved, as a result of which increased resistances to cutting, which may occur, e.g., when cutting thick and tear-resistant threads, is reliably overcome.

By arranging the thread catcher, the thread cutter, and the angle lever on the needle plate, it is also possible to install the thread cutting device subsequently into sewing machines already sold.

The thread catcher can be designed with a holding finger opposite the conventional barb, for the leg of the needle thread leading to the needle. This increases the reliability of the sewing starting at the beginning of the next sewing process in conjunction with the particularly short fabric-side thread ends. This is achieved such that immediately after the separating tip of the thread catcher has penetrated into the needle thread loop, the needle-side leg of the loop is caught by the holding finger, i.e., the notch between the holding finger and the separating finger, and thus fed in from the needle thread bobbin even during the further separation process. When the shuttle has subsequently wound the needle thread loop around the bobbin case, the shuttle thread and the fabric-side leg of the needle thread loop are located behind the barb of the thread catcher. The needle thread will pass from the barb below the thread catcher along the needle-side loop leg and to the notch between the holding finger and the separating finger, after which it rises up to the stitch hole. Consequently, since the needle-side leg of the loop does not ascend from the barb directly to the stitch hole, but via the detour of the notch between the holding finger and the separating finger, the needle-side thread end is longer after thread cutting by the length of the detour, and the reliability of sewing start is thus improved.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE EMBODIMENT

Figure 1:
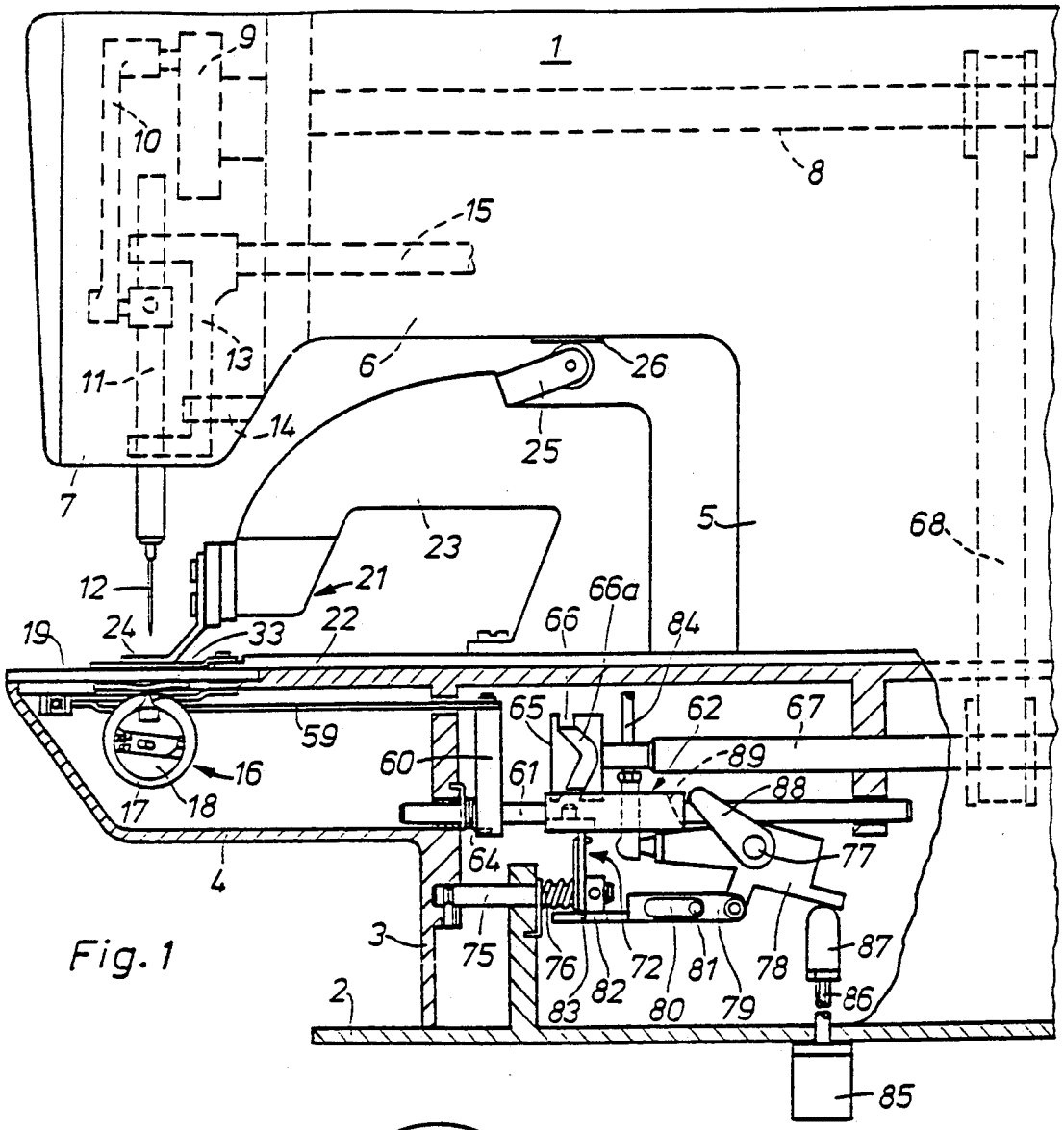
FIG. 1 is a partial cutaway of part of a sewing machine with the thread cutting device.

The sewing machine comprises a housing 1, which consists of a support plate 2, a base 3, a bracket 4, a post 5, and an arm 6 that ends in a head 7. In the arm 6 is mounted an arm shaft 8, which drives a needle bar 11 via a crank 9 and a guide 10. A thread-guiding needle 12 is fastened in the needle bar 11.

The needle bar 11 is accommodated in a frame 13 that is mounted displaceably on a pin 14 extending in parallel to the longitudinal axis of the arm 6 and is connected to a pushrod 15 extending in parallel to it. The pushrod 15 forms the driven member of a known zigzag stitch placer which is not shown. Such a stitch placer is represented and described, e.g., in West German patent Specification No. 33,20,158.

To form double lock stitches, the needle 12 cooperates with a double-rotating shuttle 16 arranged in the bracket 4, which contains a rotating shuttle body 17 and a stationary bobbin case 18. A needle plate 19, which has a stitch hole 20 in the form of an elongated slot for the passage of the needle 12, is arranged in the bracket 4 above the shuttle 16.

A fabric holder 21, which has a lower clamping jaw 22 and an upper clamping jaw 23, is arranged on the bracket 4. The upper clamping jaw 23 contains a spring-loaded holding plate 24, which can be lifted off from the lower clamping jaw 22 in the known manner via a roller lever 25 and an essentially vertically movable pressing plate 26. The feed movements of the fabric holder 21 and the setting of the zigzag stitch placer are controlled by a cam plate that is not shown, as is disclosed in the aforementioned West German Patent Specification No. 33,20,158.

A thread cutter 28, designed as a flat slide, is displaceably arranged in a flat guide groove 27, which extends in parallel to the plane of rotation of the shuttle 16 and arranged on the lower side of the needle plate 19 in the area of the stitch hole 20. The thread cutter 28 contains a rectangular recess 29, whose lower left limiting edge as shown in the drawing forms a first cutting edge 30. The thread cutter 28 is held secured against falling off by two guide elements 31 fastened by screws to the needle plate 19.

Together with a stepped recess 32 each of the guide elements 31 form a guide for a thread catcher 33 designed as a flat slide, which is in direct contact with the lower side of the thread cutter 28 and is displaceable in parallel to the plane of rotation of the shuttle 16, just like the thread cutter 28. The right end zone of the thread catcher 33 as seen in the drawing, which always remains outside the guide elements 31, is arched slightly upward and ends in an oblong separating tip 34 that is arranged essentially centrally. A short holding finger 35 is arranged at a closely spaced lateral location from the separating tip 34, as a result of which a notch 36, which has the shape of a groove, is formed between the separating tip 34 and the holding finger 35.

In its upwardly arched section, the thread catcher 33 has an essentially longitudinally directed recess 37 in the form of an elongated slot, whose end facing the separating tip 34 is located in the vertex plane of the arched section, as a result of which the half-round upper limiting edge of the recess 37 forms a second cutting edge 38. A recess 39 that extends obliquely in the direction of the recess 37 is also provided in the thread catcher 33, as a result of which a barb 41 is formed in conjunction with the longitudinal edge 40.

At the end of the thread catcher 33 opposite the separating tip 34, two flaps 42, 43 that are bent down form a guide for a ball pin 44 of a drive lever 45, which is mounted on the needle plate 19 with a collar screw 46.

The drive lever 45 is connected via a hinge pin 47 to a tie rod 48, whose opposite end, i.e., the opposite end of the tie rod" is bent down. The bent-down section of the tie rod 48 has a longitudinally directed, straight guide slot 49 and carries a short, upwardly projecting lug 50. A hinge pin 51 fastened to the needle plate 19, on which hinge pin a flat angle lever 52 is mounted, engages in the guide slot 49.

A control slot 53, in which the lug 50 engages, is provided in a leg of the angle lever 52 that extends between the bent-down section of the tie rod 48 and the needle plate 19. The control slot 53 is subdivided into two stop sections 54, 55 and one movement section 56 located between these two. An elongated slot 57, in which a pin 58 fastened to the thread cutter 28 engages, is provided at the end of the other leg of the angle lever 52.

One end of a tie rod 59, whose end is connected to a support 60, acts on the hinge pin 47 of the drive lever 45. The support 60 is attached to a rotatably mounted and axially displaceable sliding bar 61. A contact lever 62, which has a cam follower member 63, is fastened to the sliding bar 61. A first leg spring 64, is arranged on the sliding bar 61, with one end attached to a rib of the base 3, and another end attached to the support 60. The first leg spring 64 applies a counterclockwise torque to the sliding bar 61 according to FIG. 2.

The contact lever 62 cooperates with a cam plate 65, which has a cam groove 66 and is attached to a shaft 67. The shaft 67 is in a driving connection with the arm shaft 8 via a toothed belt drive 68. The contact lever 62 is associated with an electromagnet 69 FIG. 2, which acts on the lower side of the contact lever 62 via a pressing member 71 arranged on the tie rod 70.

The contact lever 62 is also associated with a lock pawl, 72, which has two stepped shoulders 73, 74 and is mounted nonrotatably on a shaft 75. A second leg spring 76 is arranged on the shaft 75, with one end attached to a rib of the base 3, and another end attached to the lock pawl 72. This second leg spring 76 applies a clockwise torque according to FIG. 2 to the shaft 75.

A three-arm lever 78 is arranged nonrotatably on a shaft 77. A shift rod 79 is hinged to one arm; the shift rod 79 has a guide slot 80 in which a lug 81 rigidly attached to the housing engages. A wedge-shaped projection 82, which cooperates with a projection 83 of matching design on the lock pawl 72, is provided at the free end of the shift rod 79.

A tie rod 84 is hinged to another arm of the lever 78; the tie rod 84 is connected to the pressing plate 26 via a lever mechanism not shown such that during a counterclockwise swiveling motion of the lever 78 according to FIG. 1, the pressing plate 26 is moved downward, as a consequence of which the holding plate 24 of the upper clamping jaw 23 is lifted. An electromagnet 85, which acts on the third arm of the lever 78 via a pressing member 87 arranged on its tie rod 86, is used to perform the swiveling motion of the lever 78.

A single-arm drive lever 88 is also attached to the shaft 77. The free end of the drive lever 88 is associated with an obliquely extending shoulder 89 provided on the contact lever 62.

MODE OF OPERATION

Several stitches before the end of a sewing operation, the speed of the sewing machine is reduced to the so-called cutting speed, from which the sewing machine can be stopped practically without delay.

Figure 2:
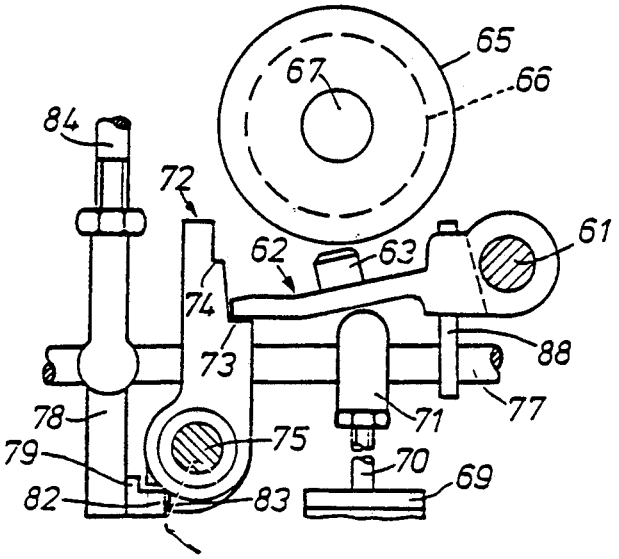
FIG. 2 is part of the drive mechanism of the thread cutting device.

During the last stitch formation process within a sewing operation, approximately at the time at which needle 12 is withdrawn from the stitch hole 20, electromagnet 69 is energized, after which it swivels the contact lever 62 upward from the position shown in FIG. 2, thus turning the cam follower member 63 into a nonascending stop section of the cam groove 66, which is specifically designated.

Until this point in time, the thread catcher 33 and the thread cutter 28 are in the resting position that is in a location spaced laterally from the stitch hole 20. When the lifted position of the contact lever 62 is reached, the leg spring 76 swings the lock pawl 72 to the right in FIG. 2, as a result of which the shoulder 74 is displaced below the front end of the contact lever 62, thus securing its position.

Shortly after the cam follower member 63 has been swung into the cam groove 66 of the cam plate 65, which is rotating synchronously with the arm shaft 8, an axially arc-shaped movement section **66*a* of the groove 66 will come into play, as a result of which the cam follower member 63 and the contact lever 62 will be displaced to the right relative to FIG. 1. The pushing movement of the contact lever 62 is transmitted to the drive lever 45 via the sliding bar 61, the support 60, and the tie rod 59, as a result of which the drive lever 45** will perform a swiveling movement.

Figure 3:
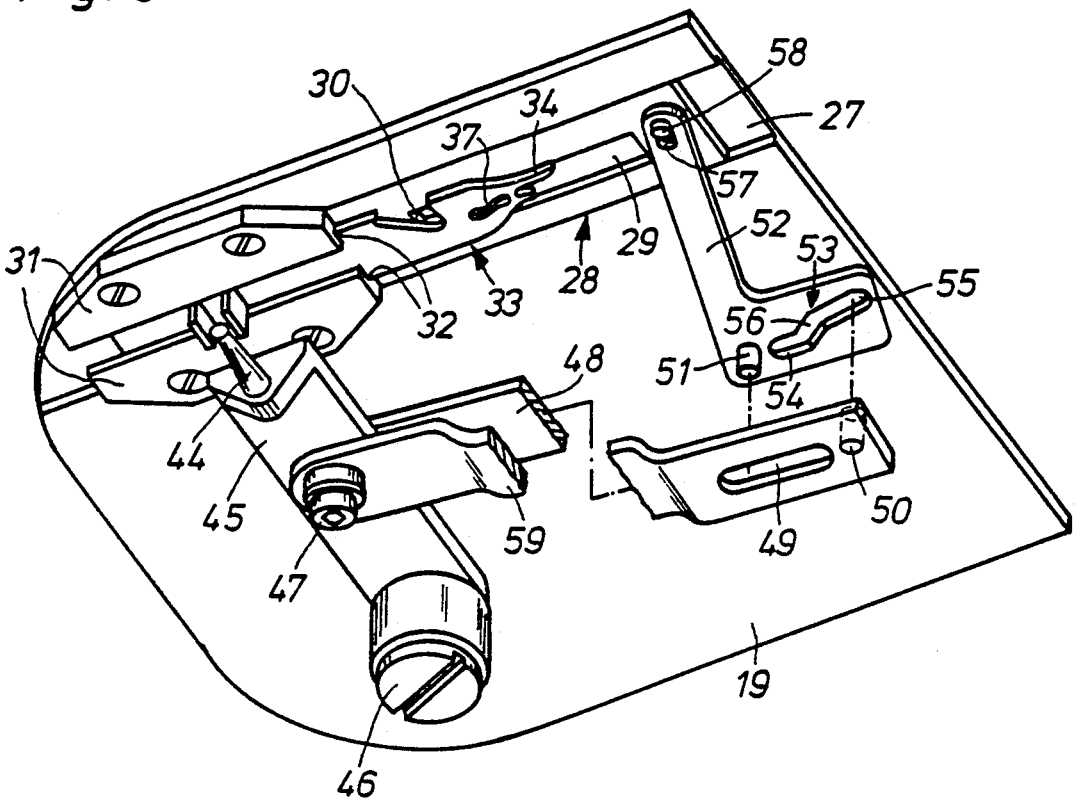
FIG. 3 is a schematic diagram of the needle plate and the thread cutting device as a bottom view of the parts of the device.
Figure 4:
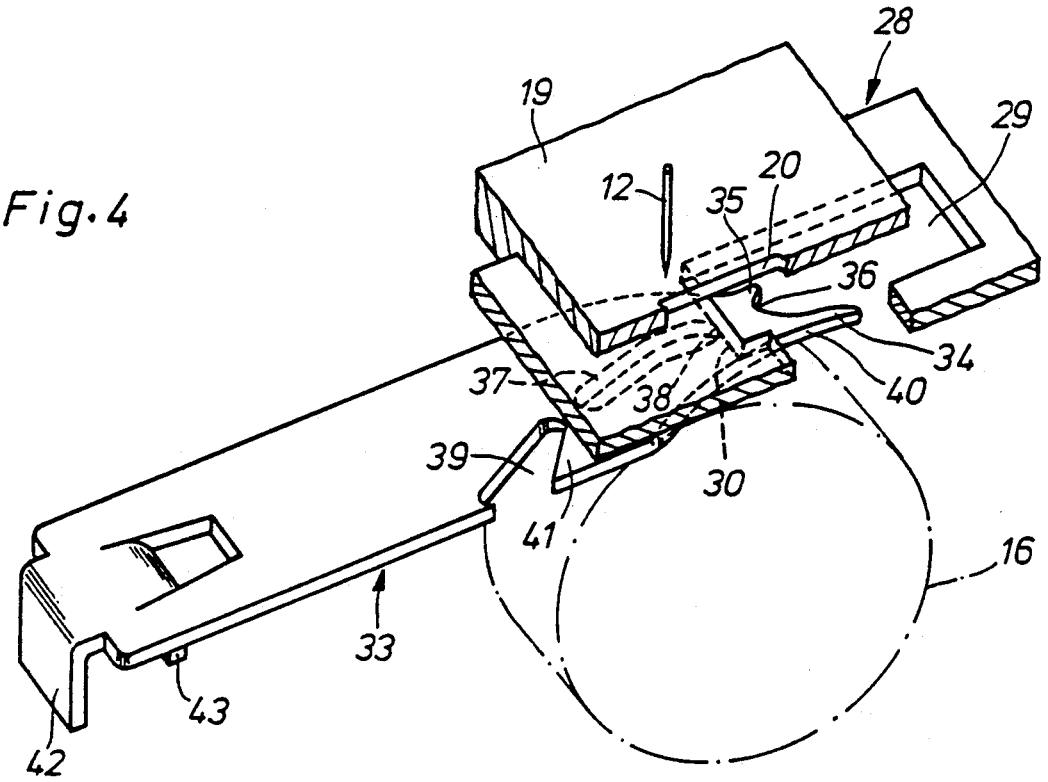
FIG. 4 is a partially cutaway schematic diagram of the thread take-up, the thread cutter, and the needle plate.

Due to the swiveling motion of the drive lever 45, the thread catcher 33 and the tie rod 48 are displaced to the right relative to FIG. 3, into their end position shown in this figure. The separating tip 34 penetrates into the needle thread loop formed by the shuttle 16, and its leg NW, which leads to the fabric W, and the shuttle thread come into contact at the longitudinal edge 40, while the leg NN leading to the needle 12 is caught by the limiting edge of the notch 36 between the separating tip 34 and the holding finger 35. During the further movement of the thread catcher and the shuttle, the needle thread loop is led by the shuttle 16 completely around the bobbin case 18, and the thread catcher 33 penetrates into the needle thread loop to such an extent that the thread leg NW leading to the fabric W and the shuttle thread G slide off from the longitudinal edge 40 and reach the recess 39 behind the barb 41.

During the forward movement of the thread take-up 33, thread is being pulled from the needle thread bobbin. After the shuttle 16 has led the needle thread loop around the bobbin case 18, the loop is pulled upward by a known take-up lever not shown of the sewing machine, and it is laid around the thread catcher 33 such that the needle-side loop leg NN passes from the stitch hole 20 via notch 36 and the two recesses, 39 and 37, to the cutting edge 38, and the fabric-side loop leg NW passes from the cutting edge 38 to the stitch hole 20.

Due to the fact that the tie rod 48 is displaced simultaneously with the movement of the thread catcher 33, the tie rod 48 moves with the guide slot 49 relative to the fixed hinge pin 51, and the lug 50 is displaced within the control slot 53. As long as the lug 50 is moving within the stop section 54, which is essentially parallel to the longitudinal axis of the tie rod 48, the position of the angle lever 52 remains unchanged, and the thread cutter 28 remains in its resting position, in which its cutting edge 30 sits at a location spaced laterally from the stitch hole 20. As soon as the lug 50 enters the movement section 56, it causes the angle lever 52 to turn and consequently the thread cutter 28 to be displaced, and this movement takes place essentially synchronously with the movement of the thread catcher 33. When the lug 50 has reached the end of the movement section 56, the cutting edge 30 is located below the center of the stitch hole 20, and the thread cutter 28 has reached its cutting position. During the subsequent movement of the lug 50 within the stop section 55, the angle lever 52 stops in its new position without any further change, as a result of which the thread cutter 28 also remains in the cutting position.

The sewing machine is stopped shortly after the needle movement has reached its top dead center. The cam follower member 63 is now at the vertex of the axially arc-shaped movement section **66*a*, and the thread catcher 33 and the tie rod 48** have reached their right-hand end position relative to the drawing.

After the sewing machine has been stopped, the electromagnet 85 is energized, as a result of which it swivels the three-arm lever 78 and the drive lever 88 counterclockwise relative to FIG. 1. Due to these swiveling movements, the pressing plate 26 is actuated via the tie rod 84, and the holding plate 24 is lifted. At the same time, the shift rod 79 is pulled to the right relative to FIG. 1 and via the wedge-shaped projection 82, which cooperates with the projection 83, the lock pawl 72 is swiveled back against the action of the second leg spring 76, after which the first leg spring 64 will again swivel the contact lever 62 downward and thus remove the cam follower member 63 from the cam groove 66. As soon as the cam follower member 63 is disengaged from the cam groove 66, the free end of the drive lever 88 comes to lie on the shoulder 89 and subsequently push the contact lever 62 into the starting position shown in FIG. 1 in the axial direction.

This push-back movement of the contact lever 62 is transmitted via the tie rod 59 to the drive lever 45, after which the latter will withdraw the thread catcher 33 and the tie rod 48. Since the lug 50 first moves within the stop section 55, the thread cutter 28 stops in the cutting position, specifically—due to the design of the control slot 53—until the thread catcher 33 with its cutting edge 38 has slid past over the cutting edge 30 of the thread cutter 28 and the needle thread N and the shuttle thread G have been cut through.

After the threads have been cut, the lug 50 reaches the movement section 56 of the control slot 53, thus causing the angle lever 52 to be swiveled again and the thread cutter 28 to be pushed back into its starting position. When the lug 50 subsequently enters the stop section 54, the thread cutter 28 stops in the position it had reached previously, while the thread catcher 33 continues to be pulled back further into its resting or starting position, in which the separating pin 34 is completely removed from the area of the stitch hole 20.

Figure 5:
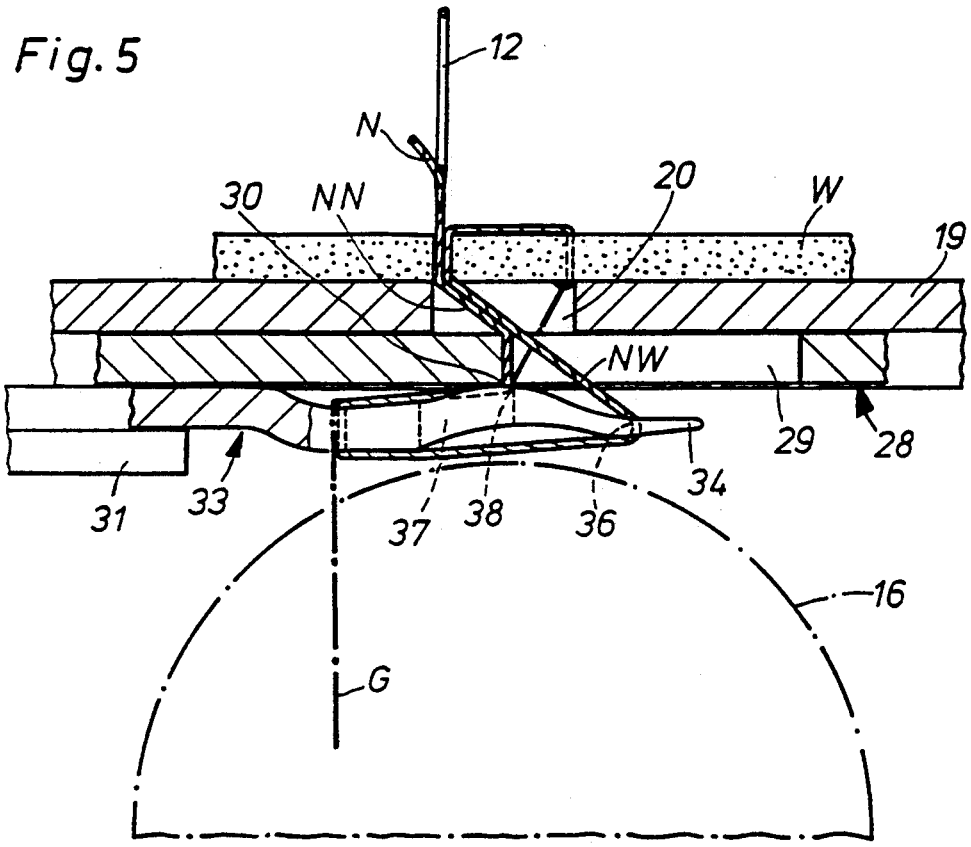
FIG. 5 is the path of the thread immediately before cutting, with the stitch made last being in the left top stitch position.
Figure 6:
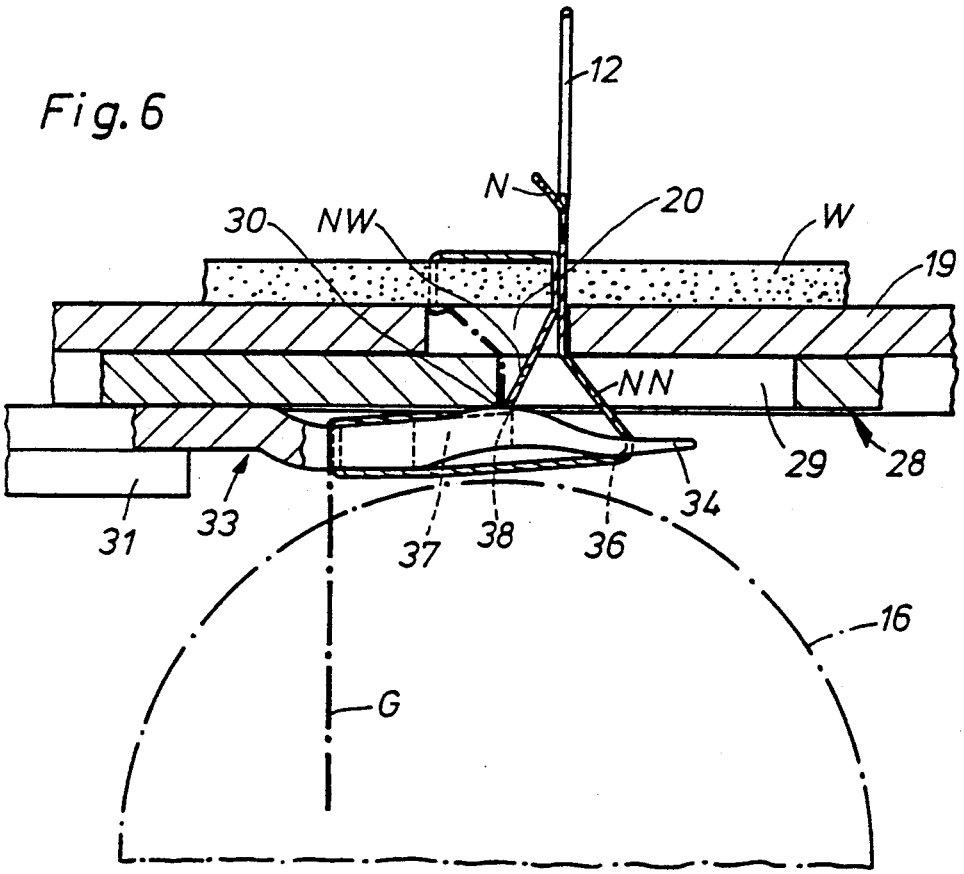
FIG. 6 shows the path of the thread according to FIG. 5, but in the right top stitch position.

As is shown by a comparison of FIGS. 5 and 6, fabric-side thread ends of essentially equal length are formed by the thread cutting device according to the present invention, regardless of the top stitch position of the last stitch. The length of the needle thread end connected to the needle 12 is also essentially unaffected by the actual top stitch position. FIGS. 5 and 6 also show that the length of the needle thread end connected to the needle 12 depends on the distance between the notch 36 and the opposite limiting edge of the recess 39. The length of this thread end can be varied by designing the thread catcher 33 appropriately.

We claim:

1. A thread cutting device on a zigzag fabric sewing machine, comprising:

a needle bar with a needle being movable to a maximum overstitch width;

a needle plate, having a stitch hole adapted to accommodate the maximum overstitch width of the needle;

a rotating shuttle below said needle plate;

a thread catcher, moveable as a function of an angular position of said shuttle and having a separating tip, a barb for a leg of the needle thread loop leading to a fabric to be sewn and a shuttle thread, a cutting edge;

a cutting knife for cutting the threads, in cooperation with said thread catcher's cutting edge, said cutting knife is moveable in a plane parallel to said thread catcher;

a gear mechanism having stopping segments and connecting said thread catcher and said cutting knife such that said thread catcher and said cutting knife are movable together from a resting position located to a side of said stitch hole into a cutting position located in an area under the middle of said overstitch width, said gear mechanism moving said thread catcher farther than said cutting knife, wherein said thread catcher separates and engages the threads, while said cutting knife remains in said cutting position, after separating and engaging the threads, said thread catcher is moveable back in the direction of said cutting knife to cut the threads, and after cutting the threads, said cutting knife can again be returned into said resting position together with said thread catcher.

2. Thread cutting device in accordance with claim 1, wherein said gear mechanism for said thread cutter is of a positive-locking design.

3. Thread cutting device in accordance with claim 1 wherein said thread catcher and said thread cutter are arranged and guided on said needle plate by a guide means; a drive lever of said thread catcher is connected via a tie rod to an angle lever mounted on said needle plate with a hinge pin such that said hinge pin is engaged in a tie rod guide slot and a lug fastened to said tie rod is engaged in an angle lever control slot of said angle lever, and said angle lever is hinged to said thread cutter via an elongated slot-pin connection.

4. Thread cutting device in accordance with claim 1, wherein said thread catcher has a holding finger for the leg of the needle thread loop leading to said needle on the side opposite from the barb in a laterally spaced location from the separating tip.

* * * * *